US006651709B1

(12) United States Patent
Poropat et al.

(10) Patent No.: US 6,651,709 B1
(45) Date of Patent: Nov. 25, 2003

(54) RETRACTABLE DEBARKING APPARATUS

(75) Inventors: Michael Poropat, Surrey (CA); Peter F. Lister, North Vancouver (CA); Rene K. Chong, North Vancouver (CA)

(73) Assignee: CAE Wood Products, G.P., Vancouver (CA)

( * ) Notice: Subject to any disclaimer, the term of this patent is extended or adjusted under 35 U.S.C. 154(b) by 0 days.

(21) Appl. No.: 10/241,358

(22) Filed: Sep. 11, 2002

(51) Int. Cl.[7] ..... B27L 1/05
(52) U.S. Cl. ..... 144/208.9; 241/287; 241/299
(58) Field of Search ..... 241/287, 299; 144/208.1, 208.9, 341, 340, 335, 208.3

(56) References Cited

U.S. PATENT DOCUMENTS

| | | | | |
|---|---|---|---|---|
| 1,189,471 A | | 7/1916 | Ochterbeck | |
| 1,397,828 A | | 11/1921 | Williams | |
| 1,439,754 A | | 12/1922 | Plaisted | |
| 3,053,294 A | | 9/1962 | Anderson | |
| 3,409,057 A | | 11/1968 | Los | |
| 3,587,684 A | | 6/1971 | Bush, Jr. | |
| 3,783,918 A | | 1/1974 | Simpson et al. | |
| 4,368,764 A | | 1/1983 | Peterson et al. | |
| 4,402,465 A | * | 9/1983 | Persson et al. | 241/183 |
| 4,583,575 A | | 4/1986 | Lundmark | |
| 4,673,012 A | | 6/1987 | O'Brien, Jr. et al. | |
| 4,685,498 A | | 8/1987 | Nakajima et al. | |
| 4,691,750 A | | 9/1987 | Nakajima | |
| 5,094,281 A | | 3/1992 | Barnhill et al. | |
| 5,516,051 A | * | 5/1996 | Brisbois et al. | 241/172 |
| 5,630,453 A | | 5/1997 | Ishizawa | |
| 5,647,418 A | | 7/1997 | Ishizawa | |
| 5,673,865 A | * | 10/1997 | Stroulger | 241/236 |
| 5,699,843 A | * | 12/1997 | Gagne | 144/208.9 |
| 5,839,490 A | | 11/1998 | Kiedaisch et al. | |

* cited by examiner

*Primary Examiner*—Allen Ostrager
*Assistant Examiner*—Shelley Self
(74) *Attorney, Agent, or Firm*—Fulwider Patton Lee & Utecht, LLP

(57) ABSTRACT

A retractable debarking block for a debarker having an enclosure to receive logs for debarking in order to vary the aggressiveness of the debarking process. The block member has a debarking surface with projecting teeth and is positionable within the enclosure of the debarker to be movable between a retracted position in which the debarking surface does not contact logs in the enclosure and an exposed position in which the debarking surface is exposed to engage logs. The block member is fittable into a rotor or drum type debarker. An actuator is provided to move the debarking surface between the retracted and exposed positions. The actuator is adapted to permit automatic movement of the debarking surface toward the retracted position if the force exerted by the logs exceeds a pre-set limit to prevent damage to the blocks and the logs. Preferably, the actuator is an airbag or telescoping cylinder operable over a range of pressures to permit adjustment of the pre-set limit. Alternatively, the actuator may be a spring that moves the block member to the extended position by default.

46 Claims, 11 Drawing Sheets

RETRACTABLE DEBARKING APPARATUS

FIELD OF THE INVENTION

This invention relates to debarking equipment for removing bark from raw logs, and more particularly, to movable debarking blocks that permit variation in the aggressiveness of debarking of logs by variation in the position of the blocks.

BACKGROUND OF THE INVENTION

In the forest industry, raw logs are converted into many different types of products such as lumber and panel products for construction, and pulp and paper products for newsprint, fine papers and tissues. In manufacturing any of these products, bark must first be removed from the raw logs before further processing can occur.

Drum or rotor debarkers have been developed to remove bark rapidly and efficiently from logs on a large scale. In such debarkers, bark is removed from the logs primarily by mechanical abrasion as the logs rub against each other within an enclosure and against abrading projections known as flights or debarking blocks fixedly mounted within the enclosure. This rubbing action is initiated by turning a drum which defines the enclosure or by rotating one or more rotors which extend into the enclosure. The rotating action of the drum or rotors tends to cause logs within the enclosure to move in a generally circular, tumbling motion to establish the mechanical abrasion described above.

The amount of abrasion required to effectively remove bark from a log depends on factors such as the log species, age, diameter, moisture content and temperature. For effective debarking, abrasion levels must be high enough to remove all the bark while causing only minimal damage to the underlying wood surface.

In conventional drum or rotor debarkers, the extent of debarking action can be controlled by changing the rotational speed of the drum or rotors or by adjusting the amount of time the logs spend in the machine. Our co-pending U.S. patent applications Ser. No. 10/194,696 filed Jul. 12, 2002 (Internal ref: 42768-102) and Ser. No. 10/194,599 filed Jul. 12, 2002 (Internal ref: 42768-103) disclose alternative arrangements for varying the aggressiveness of debarking involving reversing the rotational direction of a drum debarker and providing movable debarking plates in a drum debarker.

Under certain conditions, the amount of debarking action needs to be increased. In conventional practice, fixedly mounted debarking blocks with roughened or serrated surfaces are used to promote abrasion and rotation of the logs. It is well known in the art that the shape and positioning of these debarking blocks can be varied to obtain more aggressive or gentler debarking. Problems, however, arise when wood properties vary from hour to hour or batch to batch of logs. This often occurs in spring or fall, when some logs may be frozen while others are not. Debarking blocks that work well for unfrozen logs will not remove bark from frozen logs. If more aggressive blocks are used for frozen logs, unfrozen logs are damaged as excess wood is removed with the bark and valuable wood fibre is lost.

Another problem with fixedly mounted debarking blocks is that the amount of debarking action can only be varied by changing the blocks. This can take several hours resulting in considerable loss of production as the process involves emptying the debarker of logs and removing and replacing each block manually.

SUMMARY OF THE INVENTION

To address the foregoing problems with prior art debarking equipment, the inventors have developed a retractable debarking block that allows for the debarking action to be adjusted during machine operation. The debarking block of the present invention includes an actuator that is used to extend or retract the block to expose or conceal an abrading surface.

Accordingly, the present invention provides a retractable debarking block for a debarker having an enclosure to receive logs for debarking comprising:

a block member having a debarking surface, the member being positionable within the enclosure to be movable between a retracted position in which the debarking surface does not contact logs in the enclosure and an exposed position in which the debarking surface is exposed to engage logs; and an actuator to move the debarking surface between the retracted and exposed positions, the actuator being adapted to permit automatic movement of the debarking surface toward the retracted position if the force exerted by the logs exceeds a pre-set limit.

In a further aspect, the present invention provides a retractable debarking block for a debarker having an enclosure to receive logs for debarking comprising:

a block member having a debarking surface pivotally mounted within a cavity openable into the enclosure to be movable between a retracted position in which the debarking surface is positioned within the cavity and does not contact logs in the enclosure and an exposed position in which the debarking surface is extended out of the cavity to engage logs; and an actuator to move the debarking surface between the retracted and exposed positions, the actuator being adapted to permit automatic movement of the debarking surface toward the retracted position if a force exerted by the logs exceeds a pre-set limit.

The present invention also provides a debarking system for a debarker having an enclosure to receive logs for debarking comprising:

debarking means positionable within the enclosure and movable between a retracted position in which the debarking means does not contact logs in the enclosure and an exposed position in which the debarking means engages the logs; and actuating means to move the debarking means between the retracted and exposed positions and adapted to permit automatic movement of the debarking means toward the retracted position if a force exerted by the logs exceeds a pre-set limit.

The apparatus of the present invention is useful in both rotor or drum style debarkers.

Preferably, the actuator comprises a member such as an airbag or telescoping cylinder that is connected to a pressure reservoir. By activating the member over a range of pressures, the extent of exposure of the debarking block can be varied to adjust the aggressiveness of debarking. As well, the range of pressures allows adjustment of the pre-set force limit beyond which the debarking block automatically moves toward the retracted position to prevent damage to the underlying wood of the logs.

In an alternative arrangement, the actuator comprises a spring member which moves the debarking block by default to the exposed position. Depending on the spring constant of the spring member and the extent to which the spring is compressed, the pre-set force limit can be set according to the type of logs being debarked.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
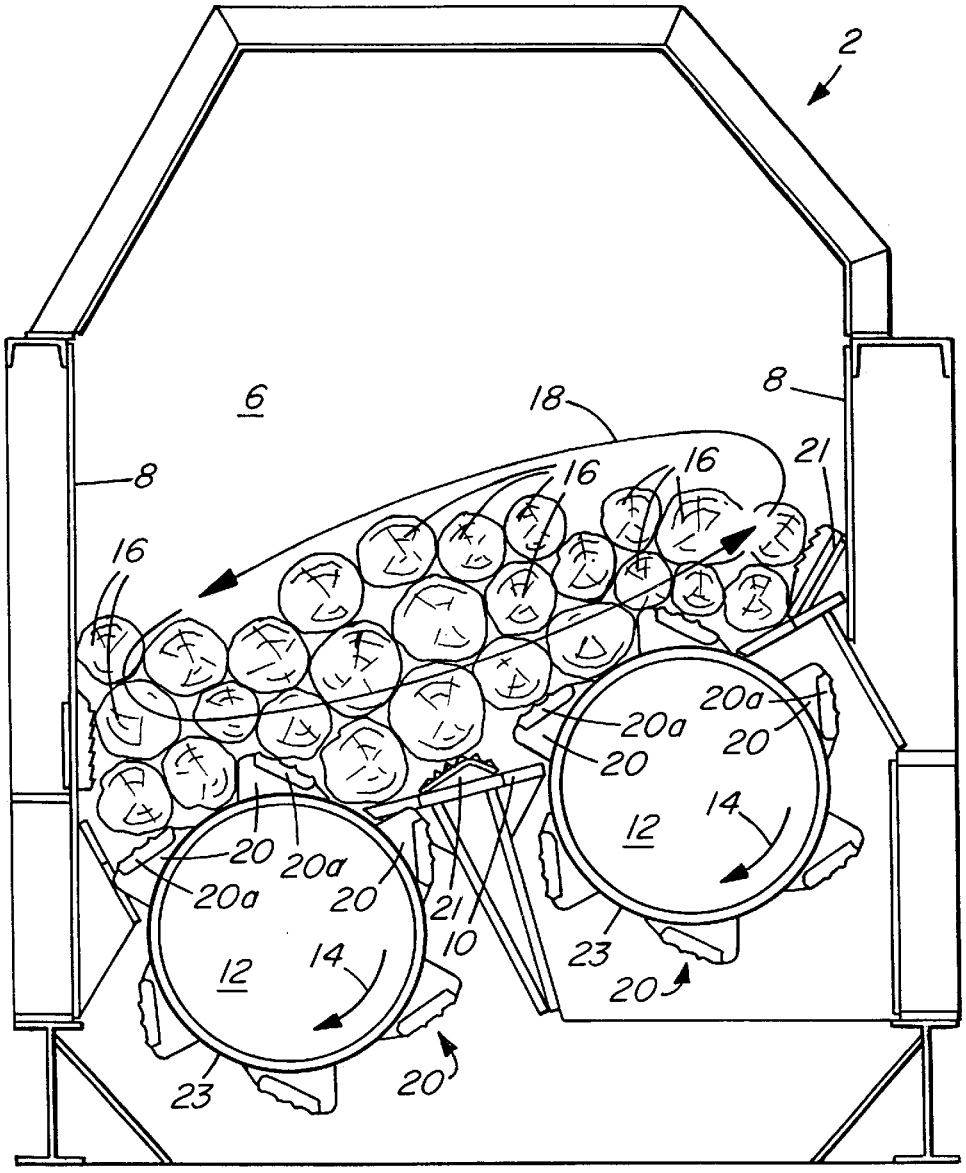
FIG. 1 PRIOR ART
FIG. 1 is a cross-section view through a rotor debarker according to the prior art.
Figure 2:
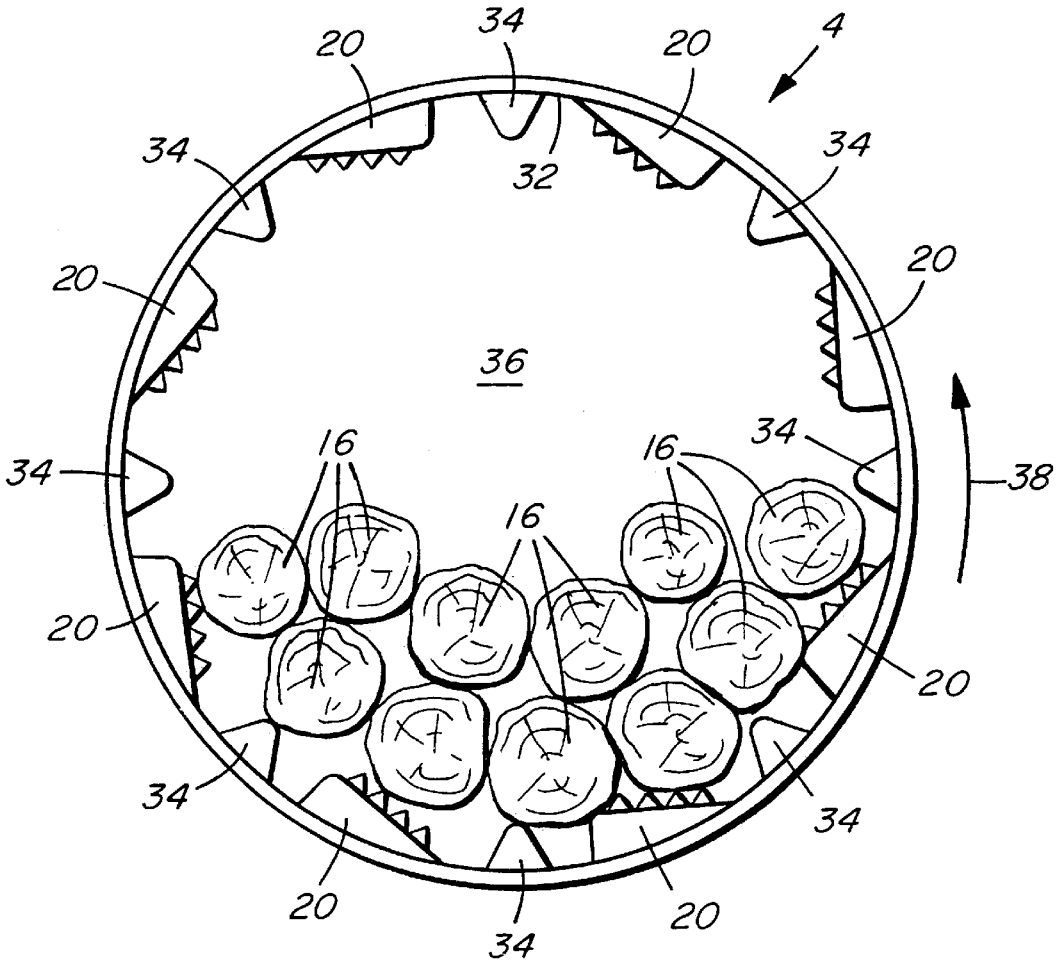
FIG. 2 PRIOR ART
FIG. 2 is a cross-section view through a drum debarker according to the prior art.

Referring to FIGS. 1 and 2, there is shown a conventional rotor debarker 2 and drum debarker 4. In the rotor debarker 2, an enclosure or trough 6 defined by spaced side walls 8 and a floor 10. Floor 10 is sloped and interrupted by a pair of rotors 12 which are rotatably mounted to partially protrude through the floor. When rotors 12 are driven in the direction indicated by arrows, raw logs 16 introduced into the trough 6 are tumbled in a generally circular path indicated by arrow 18 resulting in debarking of the logs as they abrade against each other. In the illustrated rotor debarker of FIG. 1, the rotors are fitted with conventional debarking blocks 20 removably mounted to the exterior peripheral wall 23 of each rotor. Blocks 20 with external serrated debarking surfaces 20*a* rotate with the rotors to assist in both movement and abrasion of the logs. Fixed debarking blocks 21 are also mounted adjacent side walls 8 and intermediate the rotors on floor 10 to increase the available abrading surface. In the conventional drum debarker 4 of FIG. 2, a hollow drum 30 is mounted for rotation about a substantially horizontal axis. In fact, the axis is typically tilted at a slight angle to aid in material flow from one end of the debarker to the other. The interior wall 32 of drum 30 is formed with a series of inwardly extending projections or flights 34 which also extend along the length of the drum interior. Flights 34 act to lift logs 16 within the drum interior 36 as the drum rotates in the direction of arrow 38. Once the lifted logs reached a certain point, they tend to tumble down under gravity to the lower portion of the drum. In tumbling, the logs collide and abrade against other logs and the sides of the drum to establish the debarking action of the drum debarker. As with the rotor debarker 2 of FIG. 1, the drum debarker 4 of FIG. 2 is fitted with debarking blocks 20 with serrated debarking surfaces 20*a* that assist in lifting and abrading the logs. With conventional drum or rotor debarkers, blocks 20 must be manually removed and left off or replaced with blocks having different debarking surfaces 20*a* in order to vary the aggressiveness of debarking. The debarking blocks are typically held in place using a series of bolts, and the removal and installation of blocks 20 is a time consuming job.

Figure 3:
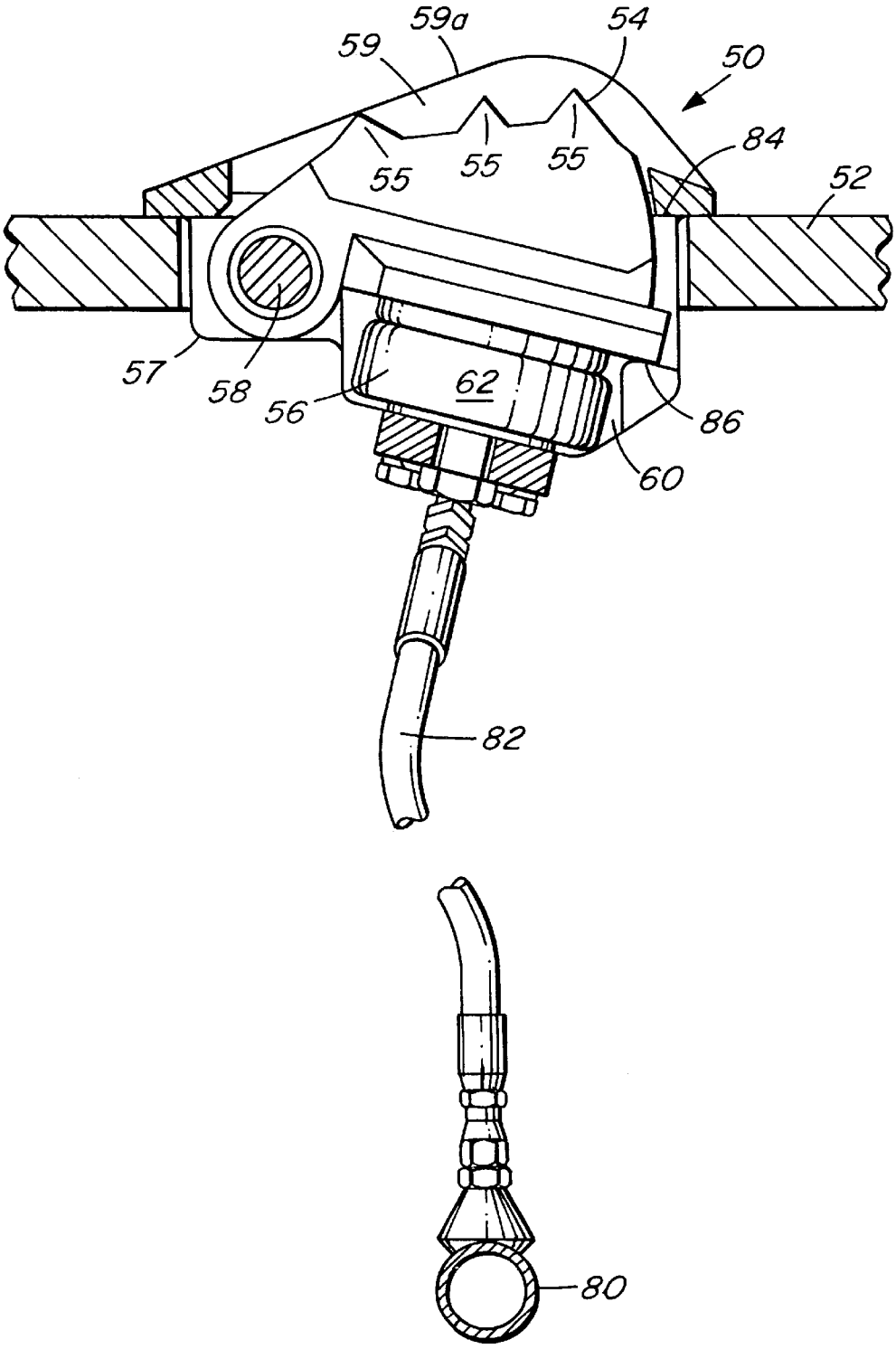
FIG. 3 is a detail view of the debarking block of the present invention according to a first embodiment in the retracted position below a stop surface.
Figure 4:
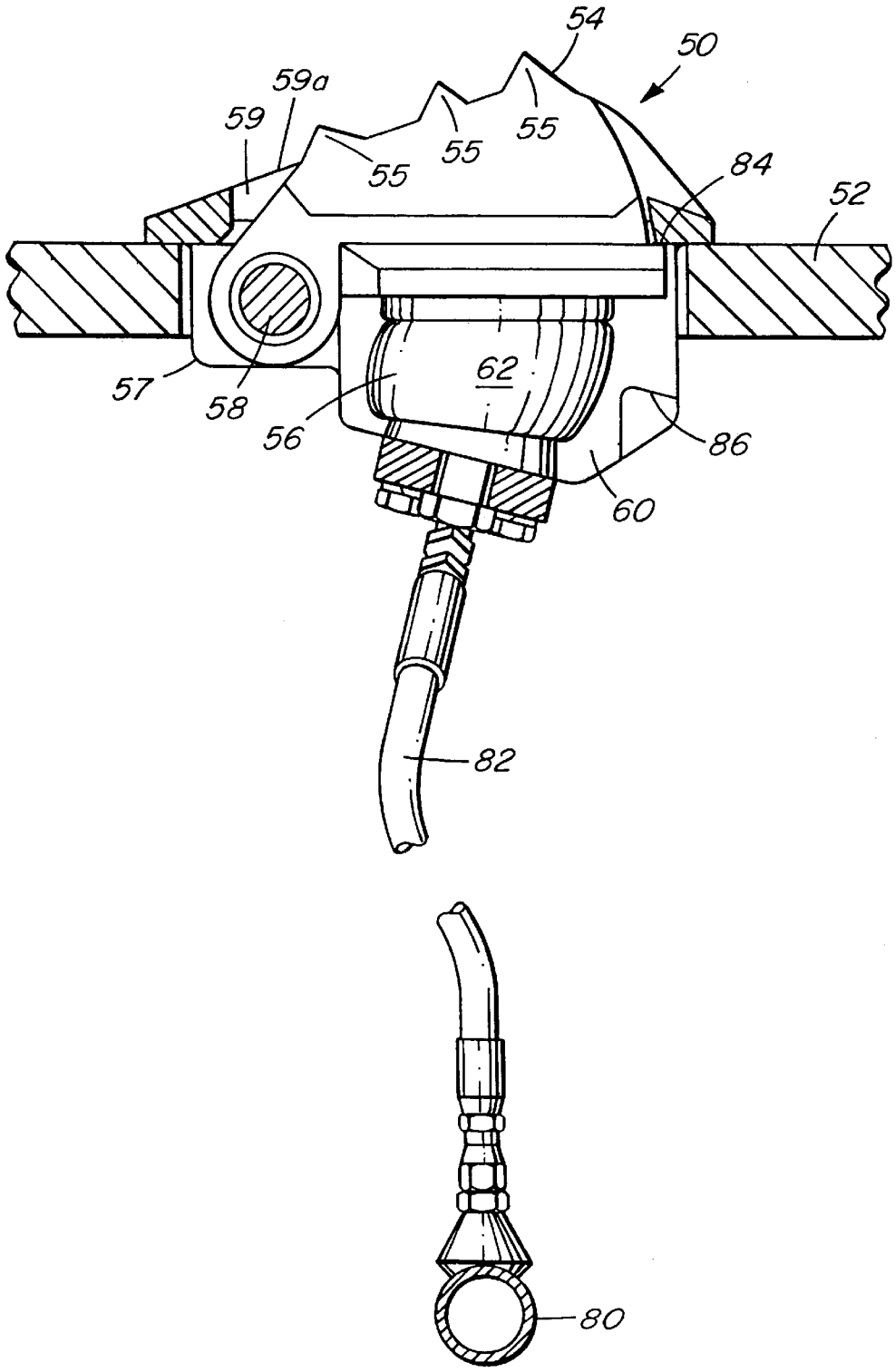
FIG. 4 is a detail view of the debarking block of FIG. 3 in the exposed position above the stop surface.

Referring to FIGS. 3 and 4, there is shown a first embodiment of a retractable debarking block 50 according to the present invention. Debarking block 50 is installable in any location that a conventional fixed debarking block is mounted. For example, the debarking block of the present invention is mountable to the interior surface of a drum debarker or the exterior wall of a rotor to replace the conventional debarking blocks 20 illustrated in FIGS. 1 and 2. In the case of a rotor debarker, retractable debarking blocks 50 can also be mounted in or adjacent the side walls 8 or floor 10 (between rotors 12) of log trough 6. In FIGS. 3 and 4, surface 52 represents the mounting surface of the rotor or drum.

Debarking block 50 comprises a block member having a serrated debarking surface 54 defined by a series of protruding teeth 55. Block member 50 is mountable to surface 52 to be movable between a retracted position as illustrated in FIG. 3 in which the debarking surface 54 does not contact logs in the debarker and an exposed position as illustrated in FIG. 4 in which the debarking surface 54 is exposed to engage and debark logs. Movement of block 50 between the exposed and retracted positions is accomplished by an actuator 56. An important characteristic of actuator 56 is that the actuator permits automatic movement of the debarking surface 54 toward the retracted position if the force exerted by the logs on the debarking block exceeds a pre-set limit.

In a preferred arrangement as illustrated in FIGS. 3 and 4, block member 50 is mounted to a frame 57 that fits into surface 52. Block member 50 is mounted to frame 57 via a pivoting arrangement to permit movement between the retracted and exposed positions. A hinge 58 at a lower surface of block member 50 connects the block to frame 57 which is in turn mounted to surface 52. Preferably, block member 50 and associated frame 57 are installed in a cavity 60 formed in surface 52 to accommodate pivoting movement of block member 50. Cavity 60 is formed in the interior wall 32 of drum 30 in a drum debarker or in the exterior peripheral wall 23 of rotor 12 or in the exterior wall 8 or floor 10 in a rotor debarker as shown in FIGS. 1 and 2. Pivotal movement of the blocking member 50 into cavity 60 defines the retracted position and pivotal movement out of cavity 60 defines the exposed position. While a pivoting arrangement is preferred, it is contemplated that debarking block 50 can also operate in a linear pop-up motion from within cavity 60 as will be discussed below.

As best shown in FIG. 3, cavity 60 is not required to fully receive block member 50 in order to define a retracted position. A projection 59 associated with frame 57 defines an upper stop surface 59*a* below which debarking surface 54 is movable to define the retracted position since the stop surface prevents logs from coming into contact with retracted debarking surface 54.

Figure 5:
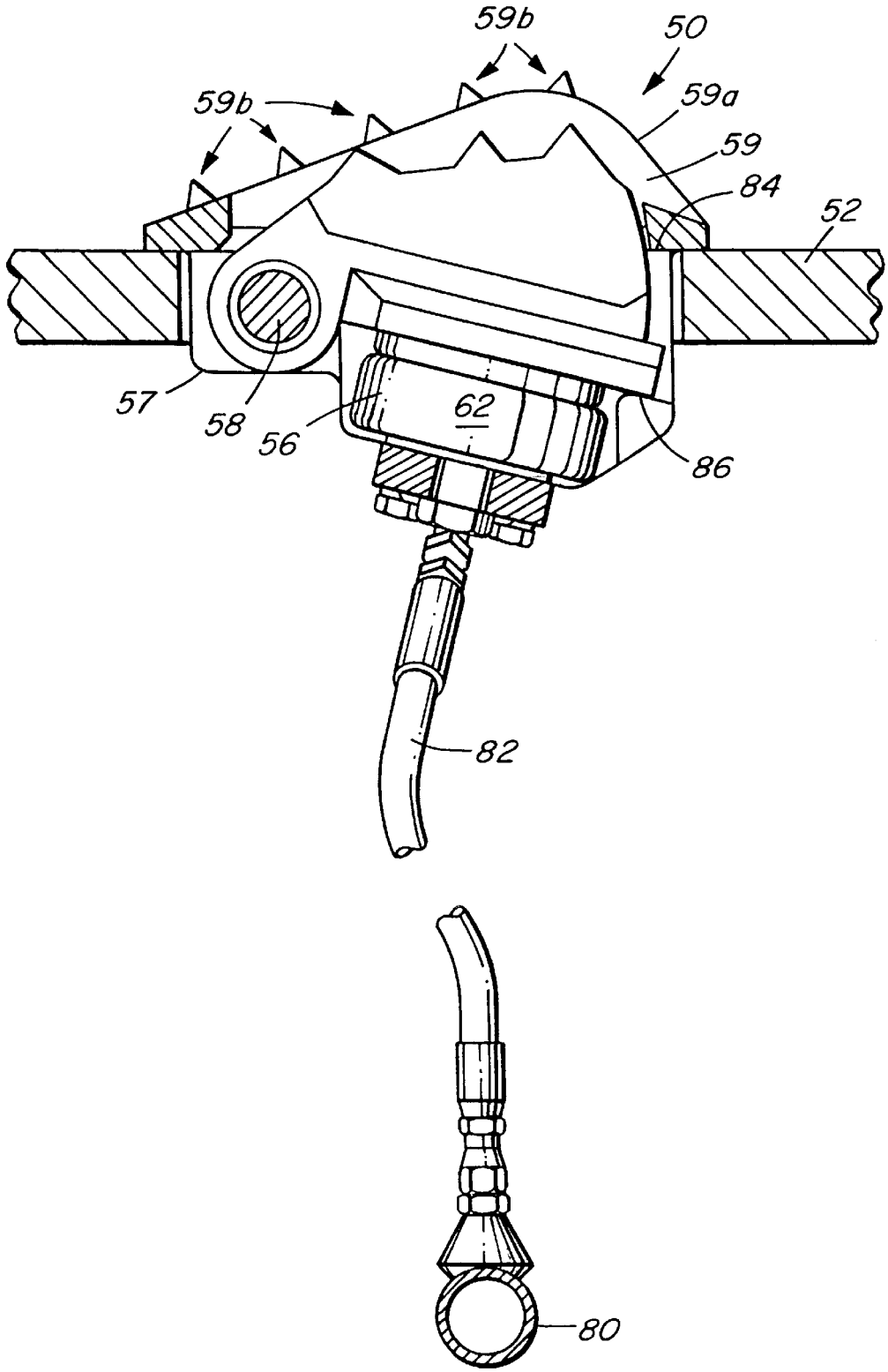
FIG. 5 is a detail view of the debarking block of FIG. 3 in the retracted position below an alternative stop surface formed with teeth.

FIG. 5 illustrates an alternative arrangement identical to that shown in FIG. 3 except that stop surface 59*a* itself is formed with smaller fixed teeth 59*b* to provide gentler debarking action when debarking surface 54 is lowered below the stop surface. Projections 59 themselves can be formed as replaceable blocks with different arrangements and numbers of teeth 59*b* to alter the aggressiveness of debarking when the debarking surface 54 is lowered below stop surface 59.

Figure 6:
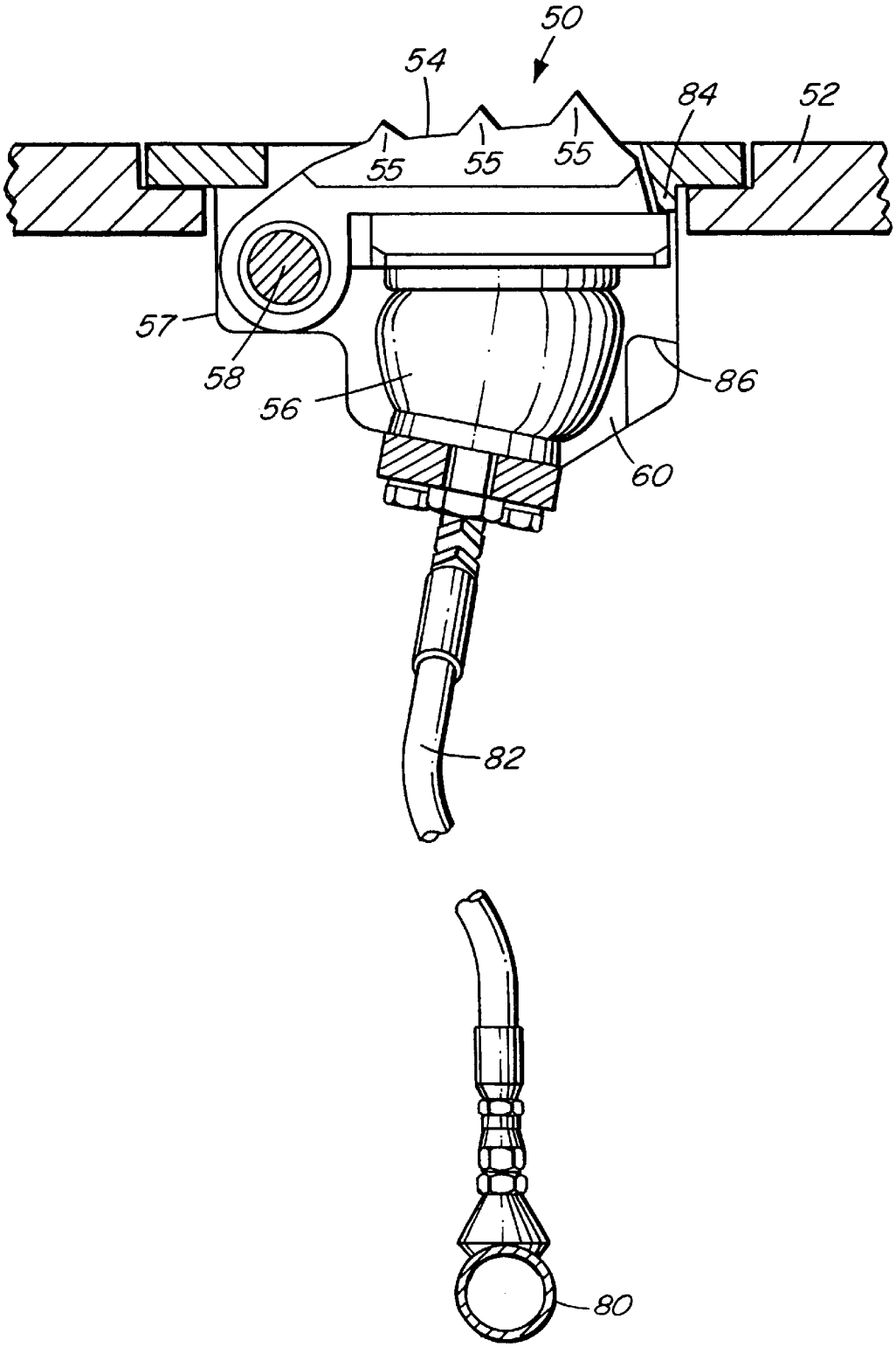
FIG. 6 is a detail view of a second embodiment of the debarking block of the present invention in which the block is fully extended from a housing cavity.
Figure 7:
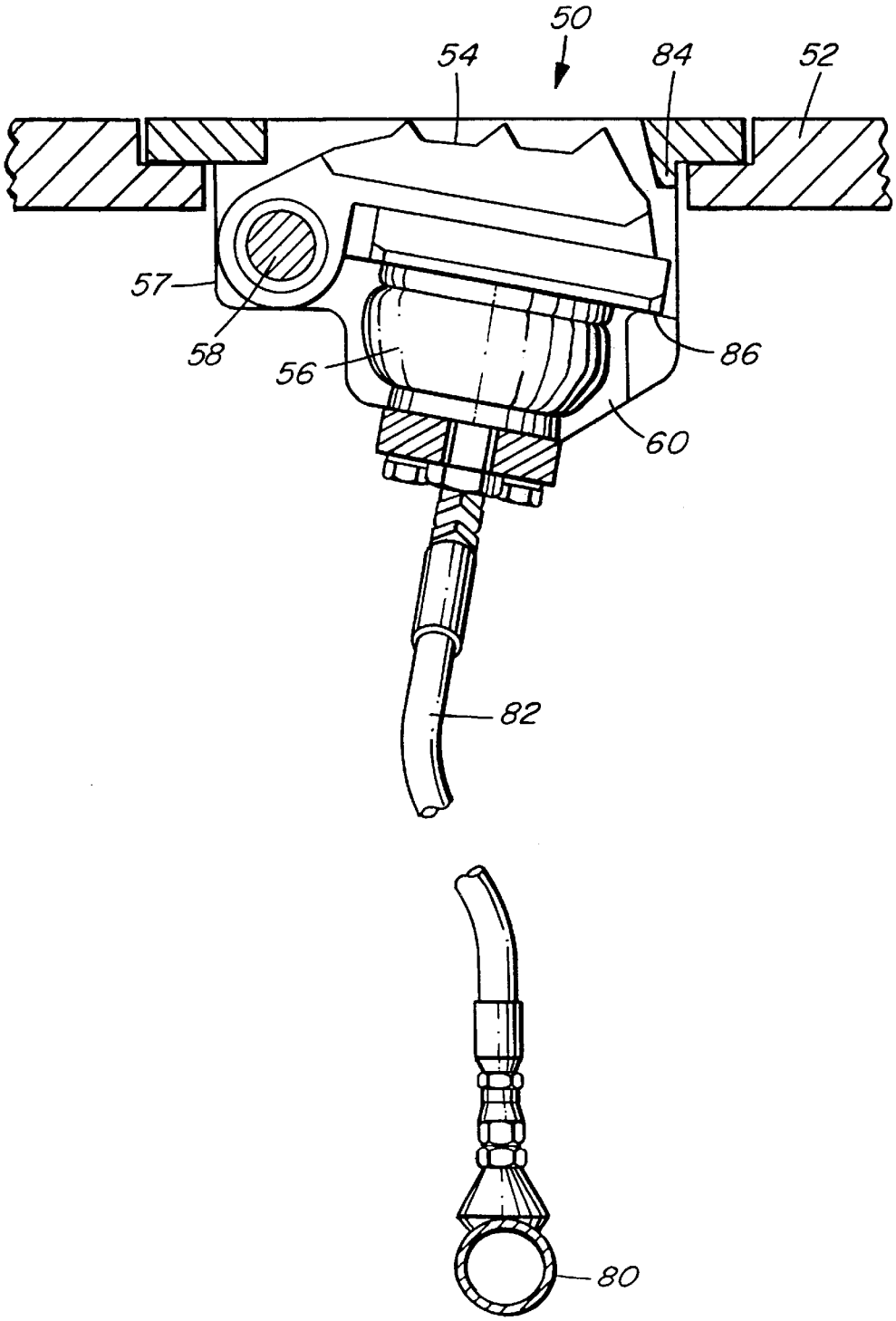
FIG. 7 is a detail view of the second embodiment with the block fully retracted within the cavity.

Alternatively, instead of relying on stop projection 59 to shield debarking surface 54, cavity 60 can be dimensioned to house block member 50 such that debarking surface 54 is withdrawn fully below surface 52. FIGS. 6 and 7 show a further embodiment of the retractable debarking block of the present invention in which block 50 and cavity 60 are dimensioned such that debarking surface 54 is withdrawn below the level of surface 52 into cavity 60 when the block is moved to the retracted position shown in FIG. 7. In the exposed position shown in FIG. 6, debarking surface 54 and teeth 55 are pivoted about hinge 58 to extend above surface 52.

In all of the embodiments of FIGS. 3–6, actuator 56 preferably comprises a resilient member operable to move block member 50 between the retracted and exposed positions. It is also preferable that the resilient member is adjustable to permit variation in the pre-set force limit and the extent to which the debarking surface is exposed. For example, as shown in the first embodiment of FIGS. 3 and 4 and the second embodiment of FIGS. 6 and 7, actuator 56 is an air bag 62 inflatable to move block member 50 to the exposed position (FIG. 4 and FIG. 6) and deflatable to allow the block member to move back to the retracted position (FIG. 3 and FIG. 7). Air bag 62 communicates via line 82 with an air pressure supply provided by header 80 common to one or more retracting blocks of a group. The air pressure in the header is controlled via a pressure regulating valve (not shown). By adjusting the air pressure in the header, the pre-set force limit in the group of retracting block members can be varied simultaneously. For a rotor debarker, header 80 is centrally located at the axis of rotation of the shaft and the air is piped into the header through a rotating air fixture at the centre of the rotor shaft. In a drum debarker, header 80 comprises a sealed air chamber incorporated around the periphery of the drum as is commonly done on ring debarkers.

Air bag 62 is inflatable to a range of pressures. When there is positive pressure in airbag 62, block 50 will pivot about hinge 58 toward the exposed position shown in FIGS. 4 and 6 until the block contacts stop point 84. When air pressure is released from airbag 62, block 50 will tend to pivot toward the retracted position only when it is moved by the force of contacting a log. The fully retracted position of block member 50 is defined by contact of the block member with stop point 86 in frame 57 that extends into cavity 60 as best shown in FIGS. 3 and 7. In addition, the natural resiliency of the air bag provides "cushioning" against the force of the logs engaging with the debarking block. When the force exerted by a log on debarking block 50 exceeds a pre-set limit determined by the inflation pressure of airbag 62, block 50 will simply be pushed downwardly below the level of projection 59 or into cavity 60 preventing further contact.

As described above, the airbag actuator 62 allows for adjustment of the force maintaining the debarking block in the exposed position. Preferably, this force is set to substantially match the bond strength between the bark and the wood of the logs being processed. The size of the teeth 55 on the debarking surface can also be selected or modified to correspond generally with the thickness of the bark. Both these features minimize damage to the underlying wood of the logs during the debarking process.

Figure 10:
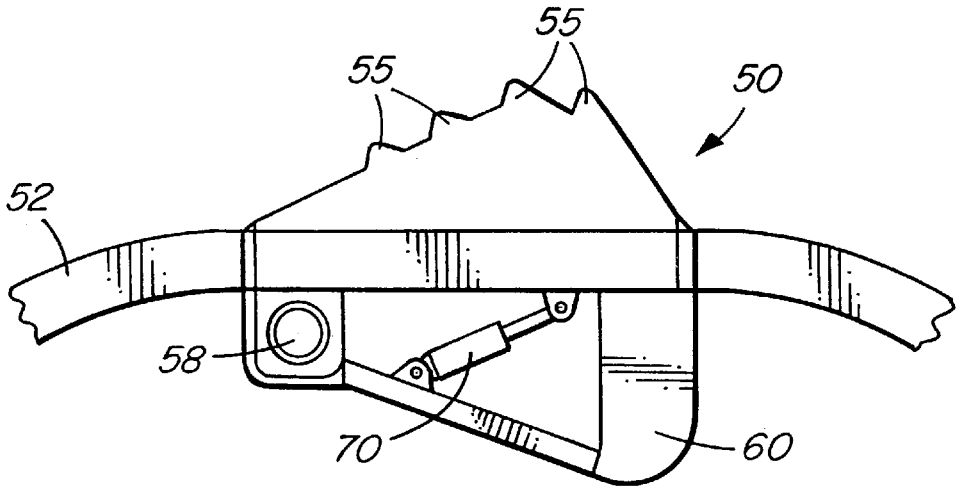
FIG. 10 is a detail view of the debarking block according to a further embodiment using an alternative actuator in the form of a pneumatic or hydraulic cylinder.
Figure 11:
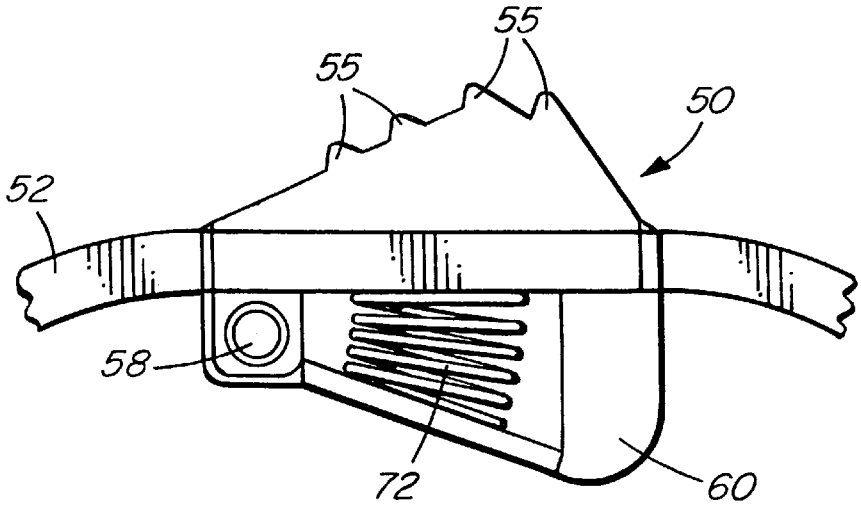
FIG. 11 is a detail view of the debarking block according to a still further embodiment using a spring member as an actuator.

FIGS. 10 and 11 illustrate alternative embodiments of the debarking block 50 of the present invention that use different resilient actuator arrangements.

FIG. 10 illustrates a debarking block in which the resilient actuator member comprises a telescoping cylinder 70. Cylinder 70 is pivotally connected between the floor of frame 59 and the underside of debarking block 50. Cylinder 70, which can be either a pneumatic or hydraulic cylinder, is connected to an appropriate air or fluid reservoir (not shown) and is operable over a range of pressures to permit variation in the pre-set force limit and the extent to which the debarking surface is exposed. In other words, intermediate positions of the blocking member are possible between the fully retracted and fully exposed positions to vary debarking aggressiveness by varying cylinder pressure using a positioning control system was used.

FIG. 11 shows a debarking block 50 in which the resilient actuator member comprises a biasing member in the form of a spring 72 which moves the blocking member to the exposed position by default. When the force of the logs exceeds the biasing force of the spring, the debarking block automatically pivots into cavity 60 toward the retracted position. Insertion of springs with different spring constants can be used to permit variation in the biasing force of the spring.

Figure 12:
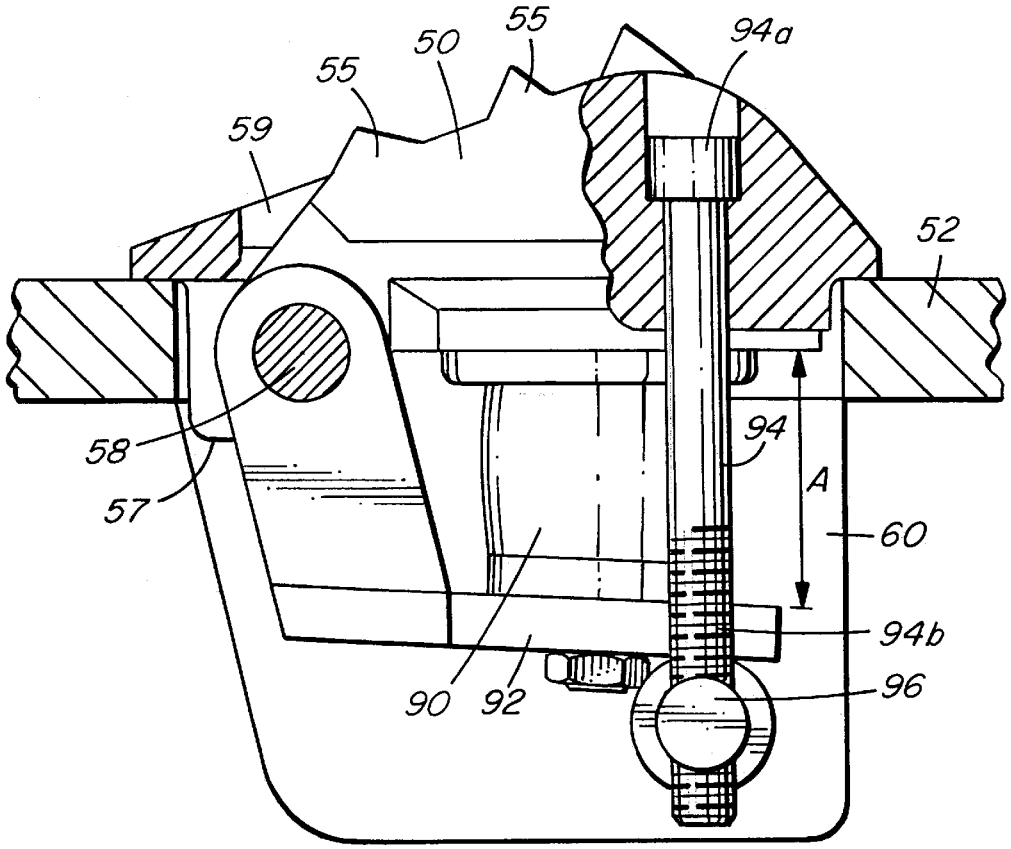
FIG. 12 is a detail view of a debarking block that employs an elastomeric member with a system for adjusting the biasing force of the elastomeric member.

Alternatively, FIG. 12 shows an embodiment of the present invention which uses an elastomeric element 90 as a resilient actuator member that includes a mechanism for varying the biasing force of the element. Preferably, elastomeric element 90 is generally cylindrical and extends between the underside of debarking block 50 and a pivoting support base 92 that is preferably mounted for movement about the same hinge 58 as mounting block 50. The pivotal position of support base 92 is adjustable to vary distance A between base 92 and the underside of the debarking block. For example, decreasing distance A compresses elastomeric element 90 thereby increasing the force that biases debarking block 50 by default to the exposed position. Increasing distance A allows elastomeric element 90 to expand which lowers the default biasing force. In the illustrated embodiment, the mechanism for varying distance A comprises a threaded fastener 94 that extends from a fixed surface relative to surface 52 to a correspondingly threaded opening in a cross member 96 welded below support base 92 at a position remote from hinge 58. Rotation of fastener 94 at exposed head 94*a* advances or retreats threaded shaft 94b of fastener 94 through the threaded opening in cross member 96 to pivot base 92 and vary distance A depending on the direction of rotation. In this manner, the biasing force of member 90 can be set to a desired level. Forces generated by logs contacting the exposed debarking surface 54 that are greater than the biasing force will cause the block to automatically pivot into cavity 60 and resile outwardly when the force is relieved.

The embodiment illustrated in FIG. 12 is shown associated with projections 59. In fact, fastener 94 extends through a projection 59. It is contemplated that the adjustment mechanism can be used in conjunction with a debarking block that retracts and extends below surface 52 without the need for projections 59. Furthermore, while an elastomeric element 90 is illustrated, it is understood that an resilient biasing member such as one or more springs can also be employed in this arrangement.

Figure 8:
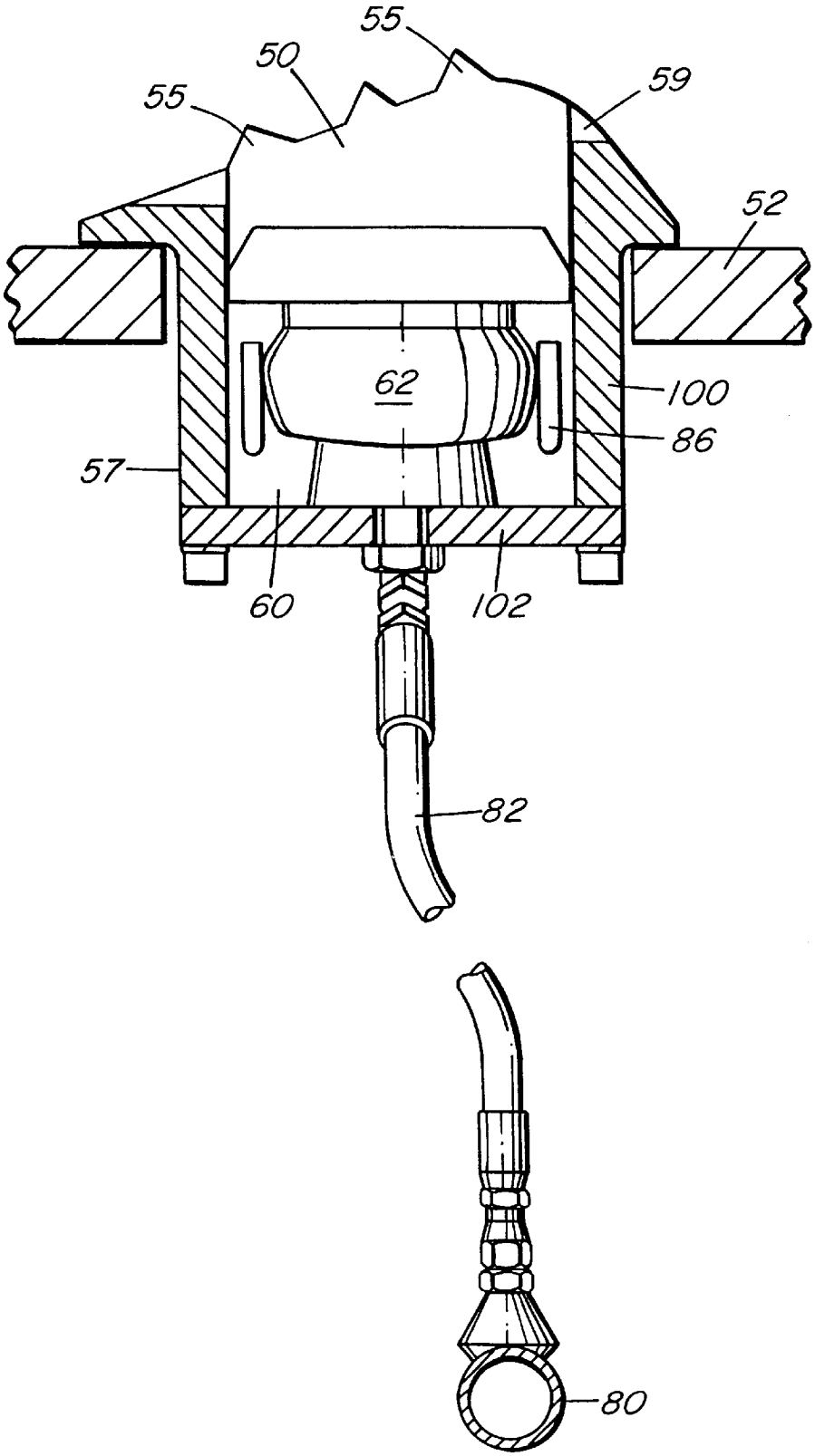
FIG. 8 is detail view of a third embodiment of the debarking block of the present invention movable in a linear manner and shown extended from the housing cavity above a stop surface.
Figure 9:
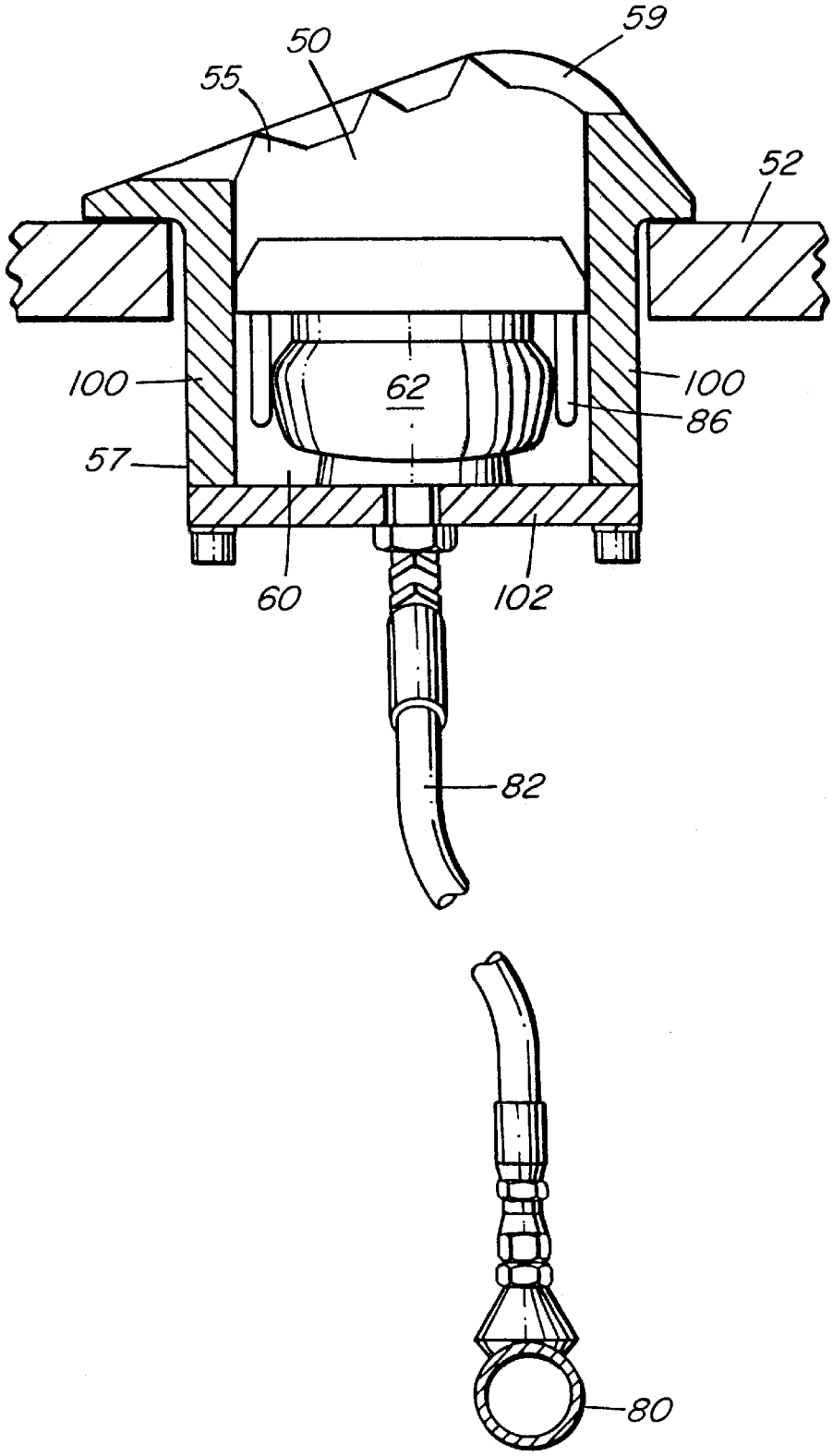
FIG. 9 is a detail view of the third embodiment in which debarking block is shown retracted below the stop surface.

Referring to FIGS. 8 and 9, there are illustrated still further alternative embodiments of the retractable debarking block of the present invention that rely on linear movement of the debarking block within cavity 60 between the exposed position (FIG. 8) and the retracted position (FIG. 9) instead of pivotal movement about a hinge. Features equivalent to the features of previous embodiments are labelled with identical reference numbers. In this case, frame 57 enclosing cavity 60 includes enclosing side walls 100 and a floor 102 with an open top through which debarking block 50 is protrudable. In the illustrated embodiment, an airbag actuator 62 is mounted between floor 102 and block 50 with line 82 communicating with common header 80 to provide the necessary actuating mechanism. Block 50 moves as a piston within cavity 60. Flange stops 86 extending from side walls 100 within cavity 60 of frame 57 define the lowermost retracted position for block 50. It will be understood by a person skilled in the art that the alternative actuators described above can be substituted for the airbag illustrated to provide the necessary activation force with automatic movement of the debarking surface toward the retracted position if the force exerted by the logs on the debarking block exceeds a pre-set limit. The linear movement debarking blocks of FIGS. 8 and 9 are shown associated with protrusions 59 at surface 52, however, it is contemplated that these debarking blocks can be used without the protrusions subject to appropriate dimensional changes to block 50 and cavity 60.

Although the present invention has been described in some detail by way of example for purposes of clarity and understanding, it will be apparent that certain changes and modifications may be practised within the scope of the appended claims.

We claim:

1. A retractable debarking block for a debarker having an enclosure to receive logs for debarking comprising:

a block member having a debarking surface, the member being positionable within the enclosure to be movable between a retracted position in which the debarking surface does not contact logs in the enclosure and an exposed position in which the debarking surface is exposed to engage logs; and an actuator to move the debarking surface between the retracted and exposed positions, the actuator being adapted to permit automatic movement of the debarking surface toward the retracted position if the force exerted by the logs exceeds a pre-set limit.

2. A debarking block as claimed in claim 1 in which the block member is adapted for pivotal movement between the retracted and exposed positions.

3. A debarking block as claimed in claim 1 in which the block member is adapted for generally linear movement between the retracted and exposed positions.

4. A debarking block as claimed in claim 1 for use in a drum debarker in which the block member is installable in a cavity formed in an interior side wall of a drum defining the log enclosure.

5. A debarking block as claimed in claim 1 for use in a rotor debarker in which the block member is installable in a cavity formed in an exterior surface of a rotor within the log enclosure.

6. A debarking block as claimed in claim 1 in which the block member is mountable within a cavity openable into the enclosure for movement into the cavity to define the retracted position and movement out of the cavity to define the exposed position.

7. A debarking block as claimed in claim 6 including a projection associated with the cavity to define a stop surface below which the debarking block is movable to define the retracted position.

8. A debarking block as claimed in claim 7 in which the stop surface is formed with projecting teeth.

9. A debarking block as claimed in claim 1 in which the debarking surface is formed with a plurality of projecting teeth.

10. A debarking block as claimed in claim 1 in which the actuator comprises a resilient member operable to move the block member between the retracted and exposed positions.

11. A debarking block as claimed in claim 10 in which the resilient member is adjustable to permit variation in the pre-set limit and the extent to which the debarking surface is exposed.

12. A debarking block as claimed in claim 10 in which the resilient member comprises an air bag inflatable to move the block member to the exposed position and deflatable to allow the block member to move to the retracted position.

13. A debarking block as claimed in claim 12 in which the air bag is inflatable to a range of pressures to permit variation in the pre-set limit.

14. A debarking block as claimed in claim 13 including stops to limit the movement of the debarking block at the retracted position and exposed position.

15. A debarking block as claimed in claim 10 in which the resilient member comprises a telescoping cylinder extendable to move the block member to the exposed position and retractable to move the block member to the retracted position.

16. A debarking block as claimed in claim 15 in which the telescoping cylinder is a pneumatic cylinder.

17. A debarking block as claimed in claim 15 in which the telescoping cylinder is an hydraulic cylinder.

18. A debarking block as claimed in claim 15 in which the telescoping cylinder is operable over a range of pressures to permit variation in the pre-set limit and the extent to which the debarking surface is exposed.

19. A debarking block as claimed in claim 10 in which the resilient member comprises a spring member which biases the blocking member to the exposed position by default.

20. A debarking block as claimed in claim 10 in which the resilient member is positioned to exert a biasing force on the blocking member to move the block member to the exposed position by default.

21. A debarking block as claimed in claim 20 including a system for adjusting the biasing force.

22. A debarking block as claimed in claim 21 in which the system for adjusting the biasing force comprises means for compressing or expanding the resilient member.

23. A debarking block as claimed in claim 21 in which the system for adjusting the biasing force comprises a movable support surface spaced apart from the debarking block to define a region therebetween to receive the resilient member extending between the support surface and the debarking block wherein movement of the support surface with respect to the debarking block acts to compress or expand the resilient member thereby varying the biasing force tending to move the block member to the exposed position.

24. A debarking block as claimed in claim 23 in which the support surface comprises a platform which is movable with respect to the block member by actuating a link extending between the platform and a fixed surface.

25. A debarking block as claimed in claim 24 in which the link comprises a threaded fastener engagable in a corresponding threaded opening in the platform such that rotation of the fastener acts to move the fastener through the opening to change the length of the fastener with respect to the platform and move the platform with respect to the debarking block.

26. A debarking block as claimed in claim 10 in which the resilient member is formed from elastomeric material.

27. A debarking block as claimed in claim 26 in which the elastomeric material is a cylinder.

28. A retractable debarking block for a debarker having an enclosure to receive logs for debarking comprising:

a block member having a debarking surface pivotally-.mounted within a cavity openable into the enclosure to be movable between a retracted position in which the debarking surface is positioned within the cavity and does not contact logs in the enclosure and an exposed position in which the debarking surface is extended out of the cavity to engage logs; and an actuator to move the debarking surface between the retracted and exposed positions, the actuator being adapted to permit automatic movement of the debarking surface toward the retracted position if the force exerted by the logs exceeds a pre-set limit.

29. A debarking block as claimed in claim 28 in which the block member is pivotally mounted within the cavity by a hinge.

30. A debarking block as claimed in claim 29 in which the actuator is positioned within the cavity to extend between a cavity wall and the block member in order to pivot the blocking member with the debarking surface about the hinge.

31. A debarking block as claimed in claim 28 including a projection associated with the cavity to define a stop surface below which the debarking block is movable to define the retracted position.

32. A debarking block as claimed in claim 28 in which the debarking surface is formed with a plurality of projecting teeth.

33. A debarking block as claimed in claim 28 in which the actuator comprises a resilient member operable to move the block member between the retracted and exposed positions.

34. A debarking block as claimed in claim 33 in which the resilient member is adjustable to permit variation in the pre-set limit.

35. A debarking block as claimed in claim 33 in which the resilient member comprises an air bag inflatable to move the block member to the exposed position and deflatable to allow the block member to move to the retracted position.

36. A debarking block as claimed in claim 35 in which the air bag is inflatable to a range of pressures to permit variation in the pre-set limit.

37. A debarking block as claimed in claim 33 in which the resilient member comprises a telescoping cylinder extendable to move the block member to the exposed position and retractable to move the block member to the retracted position.

38. A debarking block as claimed in claim 37 in which the telescoping cylinder is a pneumatic cylinder.

39. A debarking block as claimed in claim 37 in which the telescoping cylinder is an hydraulic cylinder.

40. A debarking block as claimed in claim 37 in which the telescoping cylinder is operable over a range of pressures to permit variation in the pre-set limit and the extent to which the debarking surface is exposed.

41. A debarking block as claimed in claim 33 in which the resilient member comprises a spring member which biases the blocking member to the exposed position by default.

42. A debarking system for a debarker having an enclosure to receive logs for debarking comprising:

debarking means positionable within the enclosure and movable between a retracted position in which the debarking means does not contact logs in the enclosure and an exposed position in which the debarking means engages the logs; and actuating means to move the debarking means between the retracted and exposed positions and adapted to permit automatic movement of the debarking means toward the retracted position if the force exerted by the logs exceeds a pre-set limit.

43. A debarking system as claimed in claim 42 in which the debarking means comprises a block member having a serrated debarking surface.

44. A debarking system as claimed in claim 42 in which the actuating means comprises a resilient member operable to move the debarking means between the retracted and exposed positions.

45. A debarking system as claimed in claim 44 in which the resilient member is controlled by a pressure reservoir and operable over a range of pressures to permit variation in the pre-set limit and the extent to which the debarking means is exposed.

46. A debarking system as claimed in claim 44 in which the resilient member comprises a spring member to bias the blocking means to the exposed position by default.

* * * * *